United States Patent [19]

DaCosta et al.

[11] Patent Number: 4,902,205

[45] Date of Patent: Feb. 20, 1990

[54] OIL PUMP FOR A HORIZONTAL TYPE ROTARY COMPRESSOR

[76] Inventors: Caio M. F. N. DaCosta, Rua Eduardo Miers 142 ap. 603,89200; Dietmar E. B. Lilie, Rua Adriano Schondermack 365,89200; Marcos G. D. DeBortoli, Rua Rio do Sul, 344,89200, all of Joinville-SC, Brazil

[21] Appl. No.: 101,930

[22] Filed: Sep. 28, 1987

[30] Foreign Application Priority Data

Sep. 30, 1986 [BR] Brazil ..... PI8604804
May 13, 1987 [BR] Brazil ..... PI8702433

[51] Int. Cl.[4] ..... F04B 39/02; F04C 29/02

[52] U.S. Cl. ..... 417/372; 418/88; 418/94

[58] Field of Search ..... 417/474–477, 417/902, 372, 366; 418/45, 156, 92, 94, 88, 153, 56, 63

[56] References Cited

U.S. PATENT DOCUMENTS

| | | | |
|---|---|---|---|
| 2,981,830 | 1/1952 | Averill | 418/45 |
| 3,429,624 | 2/1969 | Freshwater et al. | 417/476 X |
| 3,597,123 | 8/1971 | Lutz | 417/476 X |
| 3,877,853 | 4/1975 | Harlin | 418/88 |
| 4,472,121 | 9/1984 | Tanaka et al. | 418/94 |
| 4,507,066 | 3/1985 | Duffy | 418/94 |
| 4,626,180 | 12/1986 | Tagawa | 418/88 |

FOREIGN PATENT DOCUMENTS

| | | | |
|---|---|---|---|
| 58-133495 | 8/1983 | Japan | 418/88 |
| 0028085 | 2/1984 | Japan | 418/63 |
| 61-241492 | 10/1986 | Japan | 418/88 |
| 1110935 | 8/1984 | U.S.S.R. | 418/88 |
| 687125 | 2/1950 | United Kingdom . | |
| 1112264 | 11/1965 | United Kingdom . | |
| 1149981 | 6/1967 | United Kingdom . | |
| 1464686 | 4/1974 | United Kingdom . | |

*Primary Examiner*—William L. Freeh
*Assistant Examiner*—Leonard P. Walnoha
*Attorney, Agent, or Firm*—Darby & Darby

[57] ABSTRACT

Horizontal Crankshaft Hermetic Compressor for use in refrigeration appliances. According to the present invention the compressor is fitted out with an oil pump having features of positive displacement, which ensures even at start up moments of the compressor an efficient lubrication of the bearings. The oil pump proposed has low energy consumption and supplies a continuous and adequate oil flow for lubricating the compressor without affecting in any perceivable manner its efficiency. According to the invention, the oil pump comprises a cylindric and eccentric portion (23) of the crankshaft (7) which is disposed with a flexible blade (25) within a cylindrical housing (26). This cylindrical housing (26) is provided in one of the bearings (5,6) supporting the crankshaft (7) or in a front cover (37) of the sub bearing (6). The blade (25) defines with the housing (26) an admission (29) and a pressure chamber (30) of the oil pump which are in fluid communication respectively with the oil sump (34) and the parts of the compressor unit requiring lubrication.

20 Claims, 6 Drawing Sheets

OIL PUMP FOR A HORIZONTAL TYPE ROTARY COMPRESSOR

The present invention relates to a hermetic compressor with horizontal cranshaft, and more specifically to an oil pump for a horizontal rotary type compressor.

Horizontal rotary type compressors are being more often used in refrigeration appliances due to the possibility of additional gain (comparatively to the vertical type ones) in terms of effective volume for the refrigerator.

In horizontal crankshaft compressors, oil circulation cannot be carried out according to the techniques usually applied in vertical crankshaft compressors, that is, to provide a centrifugal pump at the lower end of the crankshaft which is immersed in the oil at the lower part of the shell, forcing the oil through the crankshaft up to the parts requiring lubrication. For lubrication of horizontal crankshaft compressors there is a need for lifting the oil from the sump to the crankshaft, wherefrom it is supplied to the bearings and other parts requiring lubrication.

One earlier method for lifting and circulating the oil is proposed by the patent specification U.S. No. 4,449,895. This patent presents a horizontal rotary type hermetic compressor whose lubrication system comprises a curved pipe which extends to the oil sump at the bottom of the shell and a coiled spring which rotates within this curved pipe. The coiled spring has one of its ends connected to the crankshaft, while its other end is immersed in the oil.

When the crankshaft is driven, it causes the coiled spring to rotate, lifting the oil through the annular passage formed between the coils of the spring and the inner peripheral surface of the pipe. The oil is led into the pressure chamber at the end of the sub bearing and then supplied to the sub bearing, eccentric and main bearing by means of oil grooves made on the crankshaft surface.

Although this system ensures a continuous supply of oil to the bearings and eccentric, it gives rise to additional mechanical losses in the compressor. These mechanical losses are caused by the friction between the coils of the spring and the inner surface of the oil pipe.

Another problem of this solution is that the shell must necessarily be longer because more interior space is needed for mounting the oil pipe at the end of the sub bearing. In addition to a greater amount of material (steel plate) required for forming the shell this increase of length causes a more intensive superheating of the suction gas, and a consequent decrease of volumetric efficiency of the compressor. This superheating is due to the heat transfer from the compressed gas discharged at high temperature into the shell to the suction gas. The suction gas is taken in through the connection pipe (inside the shell). The longer this pipe is the greater the amount of heat transferred through its wall, and so the superheating of the suction gas.

Still another problem of this solution concerns with high cost involved in manufacturing the coiled spring, since the noncircular cross section wire requires a specific project for its manufacturer.

Another method known for lifting and circulating the oil is proposed by the U.S. Pat. No. 4,472,121. This patent discloses a lubrication system for a horizontal rotary type compressor in which the lubricant oil accumulated in the bottom of the shell is forced into a lubrication bore formed centrally and axially in the crankshaft by the effective use of the refrigerant gas pulsation under high pressure discharged from the compression chamber. For this purpose the compressor is provided with: a lubricant oil feed tube, one end of which is in communication with the lubrication bore of the crankshaft of its other end is opened into the lubricant oil in the oil sump; and a refrigerant gas discharge pipe, one end of which is inserted within the end of the lubricant oil free tube opened into the oil sump and its other end is in communication with the refrigerant gas discharged from the compression chamber.

When the refrigerant gas is discharged from the discharge pipe into the end of the oil feed tube (opened into the oil sump), the lubricant oil accumulated in the bottom of the shell and mixed with refrigerant gas is forced into lubricant oil feed tube through a gap formed at the overlapping end portions of the two pipes. The lubricant oil is stored in an oil collector and distributed through a central lubrication bore to the parts requiring lubrication.

In spite of its simple construction and low cost, this system has the inconvenience of providing an insufficient lubrication at the moment of starting the compressor, because the refrigerant gas pressure in the discharge pipe is insufficient for forcing the oil accumulated in the oil sump into the oil feed tube and for lifting it up to the crankshaft. This insufficiency of lubrication, besides causing noise due to the contact of the metallic parts, brings about an early wear of the compressor components.

Another inconvenience of this device is that it causes the refrigerant to be absorbed by the oil, reducing its viscosity and thus altering the lubrication conditions of the bearings. This absorption of refrigerant by the oil also causes a reduction of refrigerant amount circulating in the refrigeration system, which results in efficiency decrease of this system.

Another undesired effect of this system concerns the pressure losses of the refrigerant gas in the discharge. These pressure losses directly affect the electric energy consumption of the compressor and consequently its efficiency.

Finally the U.S. Pat. No. 4,568,253 discloses an oil pump for a hermetic rotary compressor with horizontal crankshaft. Its crankcase is provided with a vertical passageway, in communication with the oil sump. The crankshaft comprises: a reduced diameter portion which forms with the crankcase an annular chamber; and a pair of oppositely angularly disposed helical grooves in communication with the annular chamber. Upon rotation of the crankshaft, a low pressure area is developed in the annular chamber causing lubricant to be drawn upwardly through the crankcase passageway and into the annular chamber. Lubricant is then delivered by the helical grooves along the opposite end portions of the crankshaft lubricating bearings and other moving parts of the compressor.

In spite of having simple construction and low cost, this pump has in practice some troubles. The helical grooves of the crankshaft end portions reduce the effective lift surface of the bearing, already reduced by the intermediate lowered portion of the crankshaft, which causes the contact and thus the wear of the crankshaft and the bearing.

Another troublesome aspect that must be mentioned is that the oil flow in this system is seriously affected by the presence of refrigerant gas, which happens mainly when the compressor starts up. This refrigerant gas is released from the oil when the compressor shuts off, forming gas bubbles which are retained in the bearing and in the crankcase passageway. When the compressor starts up, the low pressure created between the crankshaft and the bearing causes the bubbles to expand, which brings about some delay in the suction and in the delivery of the oil to the bearing making its lubrication difficult.

It is an object of the present invention to disclose a lubrication system for a horizontal crankshaft hermetic compressor which is capable of overcoming the aforementioned deficiencies.

It is also an object of the present invention to describe a horizontal rotary type hermetic compressor having a pump with low energy consumption that delivers a continuous and adequate oil flow for lubricating the compressor without affecting its efficiency.

It is also an object of the present invention to propose a horizontal crankshaft hermetic compressor having a self priming pump which is capable of providing an efficient lubrication when compressor starts up and supplying the oil into the bearings quickly and independently of the refrigerant gas retained in the lubrication circuit.

It is another object of the present invention to propose a horizontal crankshaft hermetic compressor having an oil pump that takes up little longitudinal space and transmits a low level of noise.

It is still an object of the present invention to propose a horizontal crankshaft hermetic compressor that is fitted out with an oil pump of simple construction, high reliability and low cost.

These and other objects of the invention are accomplished in a horizontal crankshaft hermetic compressor of the type that comprises: a compressor unit including a cylinder which houses a piston, this piston being driven by a crankshaft which is supported by a main bearing and a sub bearing; an electric motor which rotatably drives the crankshaft; an oil pump which is defined around a portion of the crankshaft and in fluid communication with the oil sump and with the parts of the unit requiring lubrication; and a hermetic shell enclosing the compressor unit, the electric motor, the oil pump and the lubricant oil sump.

According to the present invention the oil pump comprises: a cylindric and eccentric portion of the crankshaft, which is disposed in such a way as to slip without a respective cylindrical housing, this housing being concentric to the geometric axis of the crankshaft and provided in one of the bearings or in a front cover of the sub bearing; at least one curved and lengthened blade element with a width corresponding to the axial length of the cylindrical housing, having at least one of its edges attached to the wall of the cylindrical housing, and being inserted at the point of contact between the cylindrical housing and the eccentric portion so as to define an admission and a pressure chamber, one in each space of the cylindric housing defined between the point of attachment of the blade element and the mentioned point of contact, the admission chamber being in fluid communication with the lubricant oil collected in the oil sump and the pressure chamber being in fluid communication with the parts of the crankshaft and the bearings requiring lubrication.

In accordance with a preferred embodiment of the invention, the blade element consists of a plastic material film that is thermally resistant and compatible with the chemical conditions of the medium.

In accordance with another embodiment of the invention, the blade element is a metal with properties of flexibility, wear and fatigue resistance. Such an oil pump has features of positive displacement since its flow depends only on the volume displaced by the eccentric.

Contrary to some of the systems described before, this device does not use the effect of viscosity or the action of centrifugal force for sucking and lifting the oil which besides imparting self-priming features to it, makes it possible for an efficient lubrication of the bearings when compressor starts up, since the oil is supplied quickly and even with the presence of refrigerant gas in the lubrication circuit.

Another favourable aspect of this device is that it has a low energy consumption and a low noise level, since the friction surfaces are considerably reduced and the clearances required between the parts are reasonably large.

Another particular advantage of this type of pump is that it delivers a continuous oil flow which can easily be adequated to the needs of the compressor unit by varying only the eccentricity, the diameter or the length of the eccentric portion, without affecting in a sensible manner its energy consumption.

These and other features and advantages of the invention will become more apparent by reference to the description of some of its preferred embodiments which is done in conjunction with the accompanying drawings, wherein.

Figure 1A:
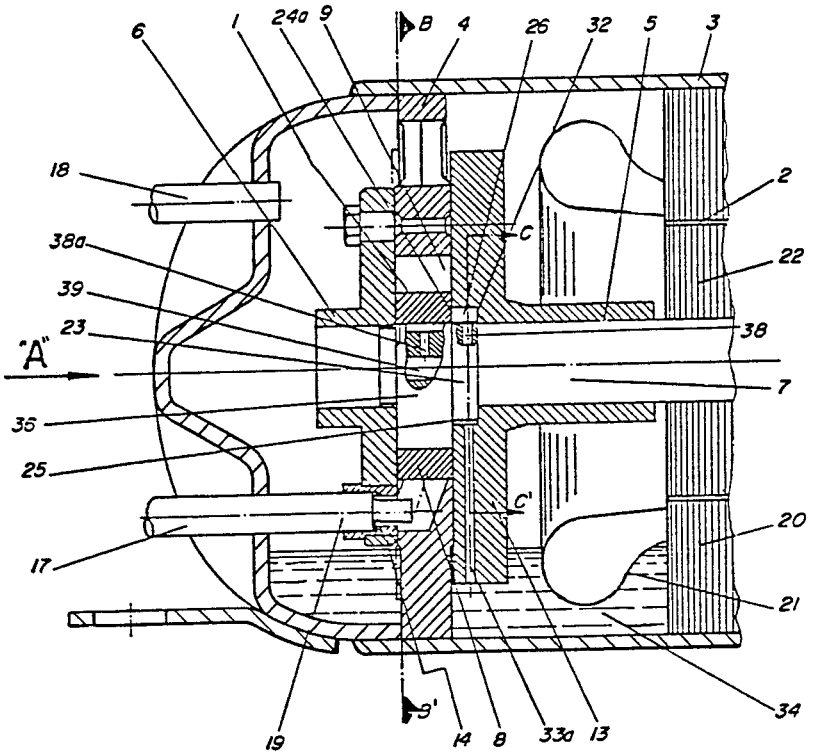
FIGS. 1A and 1B are partial longitudinal sectional views of a horizontal rotary type hermetic compressor in accordance with two preferred embodiments of the present invention.

Referring to the figures above, the horizontal rotary type hermetic compressor includes essentially a compressor unit 1 and electric motor 2, both mounted within a shell 3.

The compressor unit 1 comprises a cylinder block 4, a main bearing 5 and a sub bearing 6. The main bearing 5 and the sub bearing 6 are screwed at the cylinder block 4 and support a crankshaft 7 that drives a rolling piston 8 within a cylinder 9 formed in the cylinder block 4.

The compressor unit 1 also includes a slidable vane 10 which is held in a slot 11 of the cylinder block 4. The vane 10 is axially forced against the rolling piston 8 by means of a spring 12 so as to slide through the slot 11 on the piston surface.

The vane 10 defines with the rolling piston 8, with the cylinder 9 and the flanged portions 13 and 14 of the main bearing 5 and sub bearing 6, tight chambers of suction 15 and compression 16 that are connected respectively to the suction inlet tube 17 and discharge tube 18, both welded to the shell 3 of the compressor. The suction inlet tube 17 is connected directly to the suction chamber 15 through its internal projection 19, and the discharge tube 18 communicates with the compression chamber 16 through the interior volume of the shell 3.

The compressor unit 1 is driven by the electric motor 2 which comprises a stator 20 with windings 21 and a rotor 22 secured on the crankshaft 7.

Referring more particularly to FIG. 1A, the crankshaft 7 has a cylindrical eccentric portion 23 disposed within the main bearing 5 or sub bearing 6. The cylindrical eccentric portion 23 is disposed in such a way as to slip within a cylindrical housing 26. This housing 26 is concentric to the geometric axis of the crankshaft 7 and provided, according to the example illustrated, in the main bearing 5. The housing depth corresponds to the axial length of the eccentric portion 23 of the crankshaft 7.

Figure 1B:
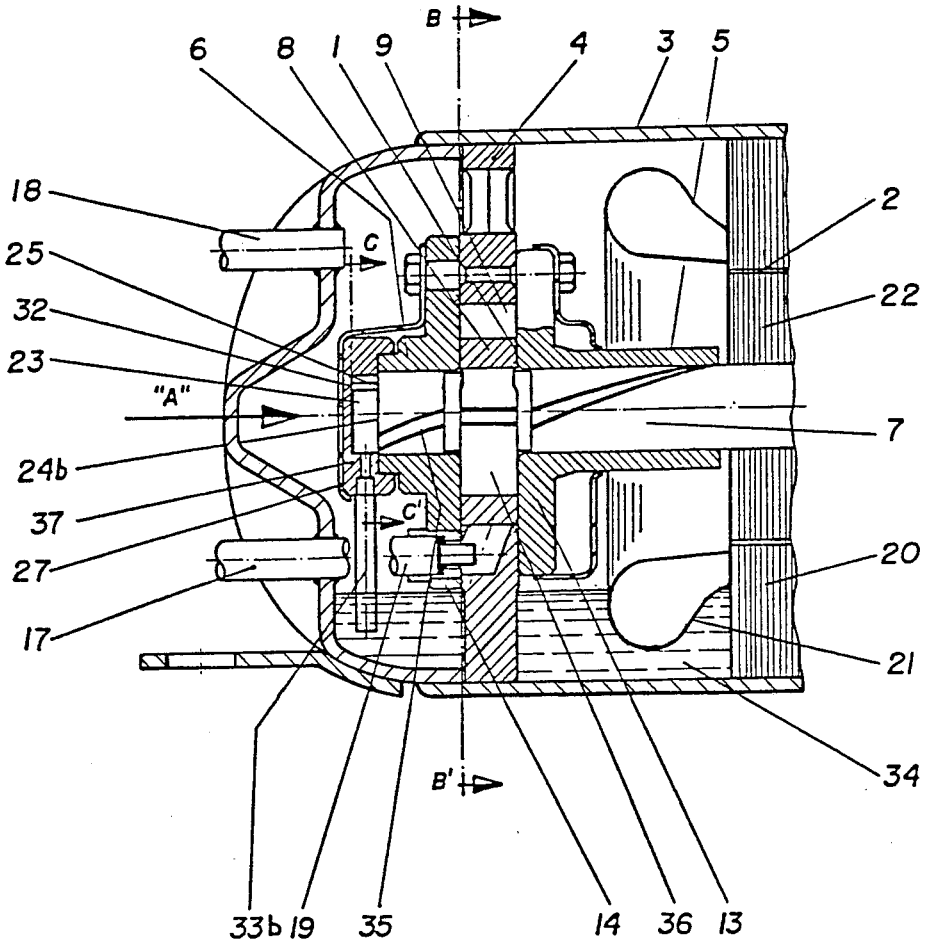
Figure 2:
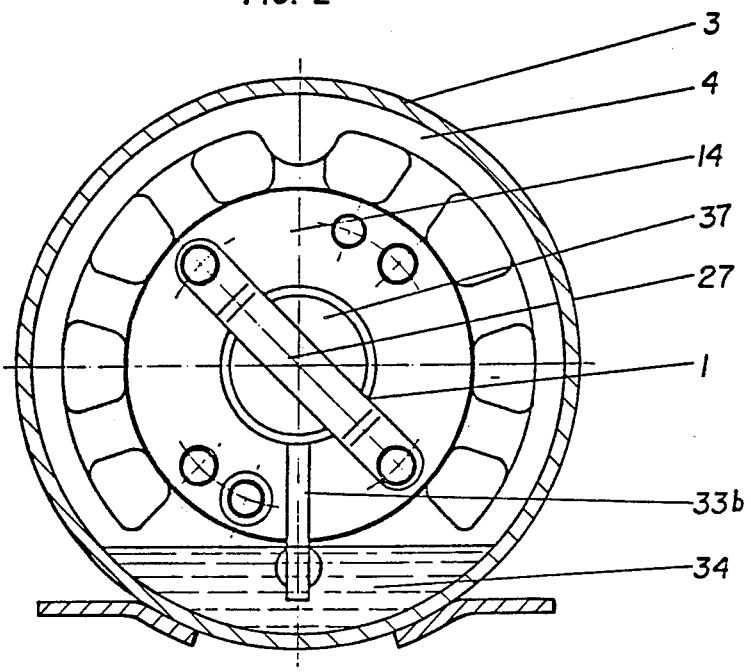
FIG. 2 is a front view of the compressor shown in FIG. 1B, as viewed from the left side of FIG. 1B.
Figure 3:
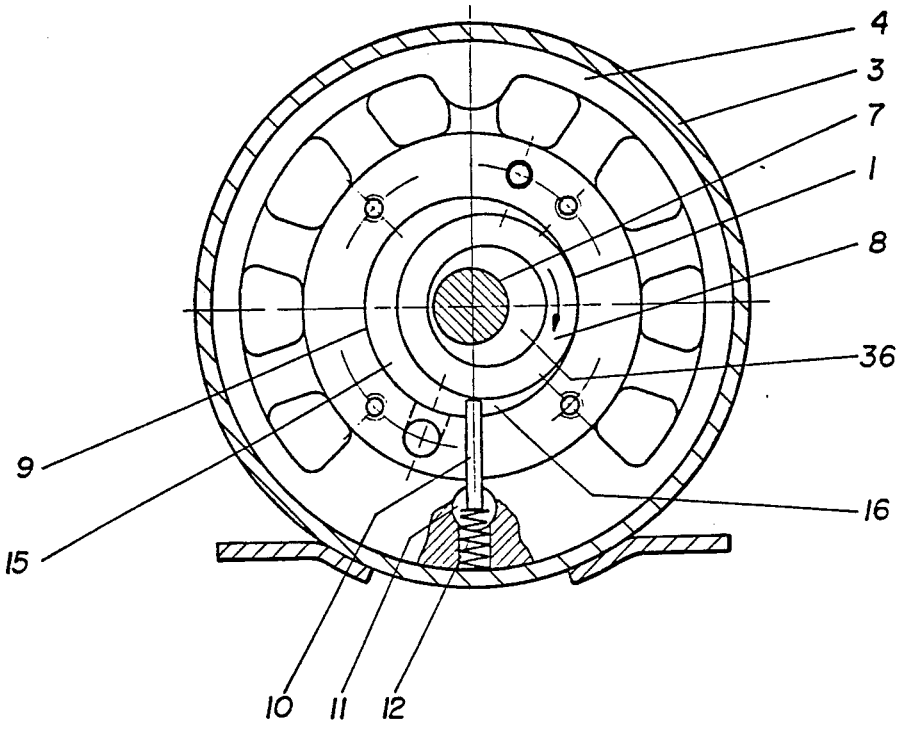
FIG. 3 is a front sectional view of the compressor shown in FIGS. 1A and 1B, taken along section line 3—3.
Figure 4:
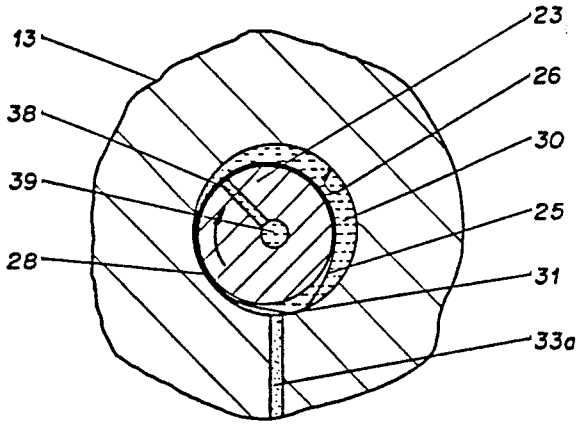
FIG. 4 is a front cross-section taken across section line 4—4 of FIG. 1A.
Figure 5:
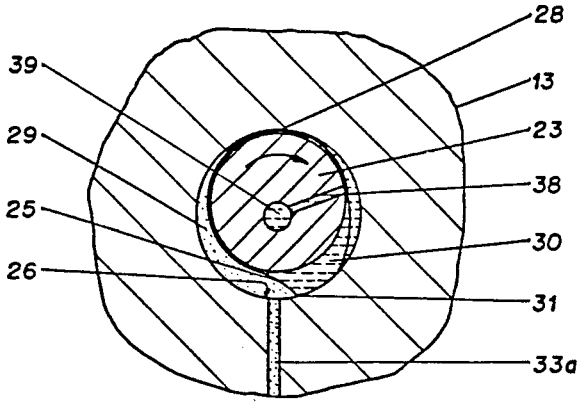
FIG. 5 is a front cross-section similar to that of FIG. 4, except showing the oil pump in a subsequent operating position.
Figure 6:
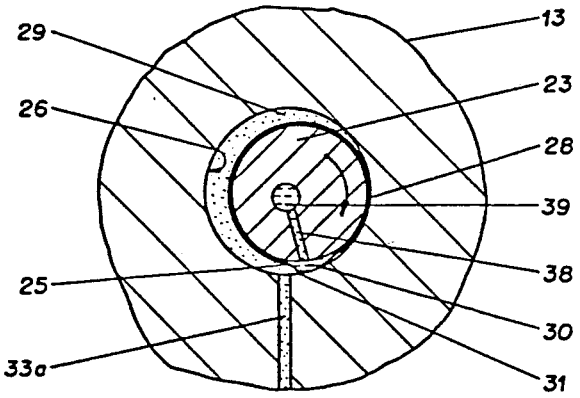
FIG. 6 is a front cross-section similar to that of FIG. 5, except showing the oil pump in a further subsequent operating position.

In FIG. 1B, the eccentric portion 23 of the crankshaft 7 has the shape of a cylindrical axial projection with reduced diameter which extends from the end front face 24*b* of the crankshaft 7. As illustrated, the cylindrical housing 26 is provided in a front cover 37 of the sub bearing 6 and is mounted on its front end by means of a metallic fastener 27 or another means.

A more detailed description of this embodiment has been omitted in the present report since it can be well understood from the description of FIG. 1A.

FIGS. 4 to 9 illustrate a blade element 25 which is attached to the cylindrical internal surface 26*a* of the housing 26 by means of one (FIGS. 4, 5, 6, 8 and 9) or both edges (FIG. 7) and is inserted through the clearance at the point of contact 28 between the cylindrical eccentric portion 23 and the housing 26.

As illustrated, the blade element 25 has the function of separatng the admission chamber 29 from the pressure chamber 30, whose volumes are delimited by the opposite surfaces of the blade element 25 and the interior surface 26*a* of the housing 26; by the edge of attachment 31 of the blade element 25 at the interior surface 26*a* of the housing 26 and the point of contact 28; and by the lateral walls of the housing 26, one of which is defined (in the example of FIG. 1A) by the lateral surface 24*a* of the piston 8 and eccentric portion 36 of the crankshaft 7, and the other by the bottom surface 32 of the housing 26.

Referring to FIGS. 1A, 4, 5, 6 and 7, the admission chamber 29 of the oil pump is connected to the oil sump 34 in the bottom of the shell 3 by means of a suction hole 33*a* which is made through the flange 13 of the main bearing 5. The pressure chamber 30 is connected to a central oil feed hole 39 by means of an oil discharge hole 38 which is radially disposed through the eccentric portion 23 of the crankshaft 7.

The distribution of the oil from the central oil feed hole 39 to the surfaces of the main bearing 5 and the sub bearing 6, and to the internal surface of the rolling piston 8 is carried out by means of one or more radial openings 38*a* (FIG. 1A). It must be noticed that the peripheral end of the oil discharged hole 38 (FIGS. 1A, 4, 5, 6 and 7) is set in a slightly advanced angular position respective to the point of contact 28 between the eccentric portion 23 and the internal surface of the housing 26, so as to make use of the whole volume of oil displaced by the pump.

Figure 8:
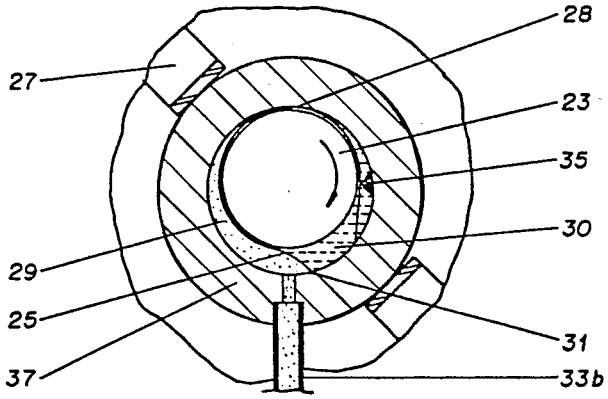
FIG. 8 is a front cross-section taken across section line 8—8 of FIG. 1B.
Figure 9:
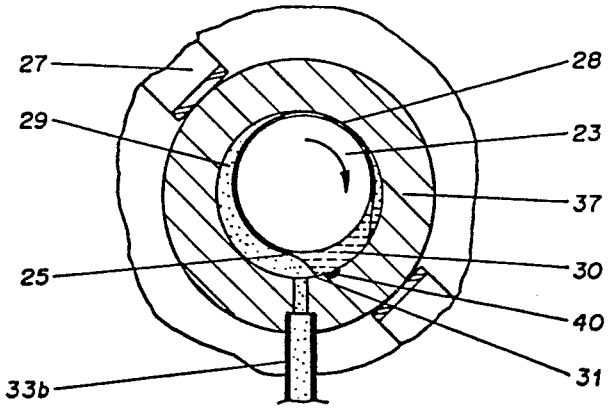
FIG. 9 is a front cross-section similar to that of FIG. 8, except for another embodiment.

Referring to FIGS. 1B, 8 and 9, the admission chamber 29 is connected to the oil sump 34 in the bottom of the shell 3 by means of a suction pipe 33*b*.

The pressure chamber 30 is connected to the sub bearing 6 and main bearing 5 by means of lubrication grooves which can have different shapes.

In FIGS. 1B and 8 helical grooves 35 are made in the surface of the crankshaft 7. These helical grooves 35 have the functions of supplying the oil along the sub bearing 6, eccentric 36 and main bearing 5 according to the conventional techniques. As shown in FIG. 8 the oil displaced by the pump is discharged through the front end of the helical groove 35 which is set in a slightly advanced angular position respective to the point of contact 28.

FIG. 9 shows another constructive example where the oil displaced by the pump is discharged through a groove 40. This groove 40 is made in the cylindrical internal surface of the front cover 37 and in the surfaces of the sub bearing 6 and main bearing 5.

An aspect that must be enhanced is that the free edge of the blade elements 25 illustrated in FIGS. 4, 5, 6, 8 and 9 is sufficiently flexible so as to make the oil pressure equal in the whole volume of the pressure chamber 30.

Another aspect to be mentioned regarding to FIGS. 4, 5, 6, 8 and 9 is that the blade element 25 can have its length reduced depending on its material and thickness. In the case where the blade element 25 consists of a plastic film, its length can be reduced provided that there is sufficient adherence of the film with the surface of the eccentric portion 23. This adherence is due to the oil film created upon rotation of the eccentric portion 23 and acts in such a way as to slightly strain the film separating the admission and pressure sides of the pump.

Figure 7:
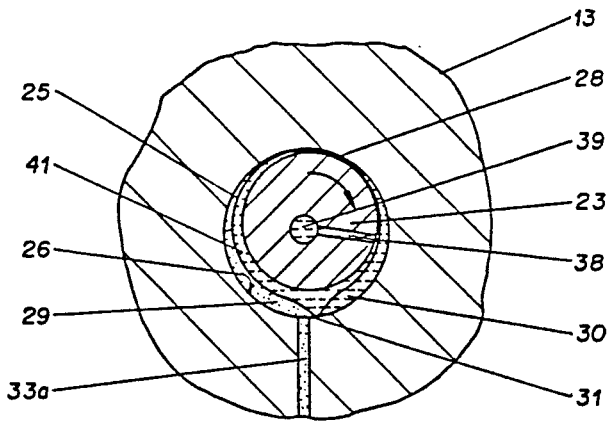
FIG. 7 is a front cross-section similar to that of FIG. 5, but for another embodiment.

As discussed, FIG. 7 differs from the other embodiments shown by having both edges of its blade element 25 attached to the cylindrical housing 26 at one area 31, rather than having one edge attached to the one area 31 and the other loose as in the other embodiments.

As the eccentric portion 23 of the crankshaft rotates, the blade element 25 divides the cylindrical housing 26 into two chambers, i.e. an admission chamber 29 having low pressure and a compression or pressure chamber 30 having higher pressure. A third chamber 41 is also formed which also functions as a compression chamber. The blade element 25 does not tightly seal leakages between the three chambers. In operation of the oil pump, the third chamber 41 becomes a chamber having intermediate pressure, that is, pressure at a level between that of the admission chamber 29 and pressure chamber 30. This intermediate pressure is high enough for injecting the oil through the discharge hole 38.

We claim:

1. A Horizontal Crankshaft Hermetic Compressor, comprising a compressor unit having a cylinder which houses a piston, the piston being driven by a crankshaft which is supported by a main bearing and a sub bearing; an oil pump defined around a portion of the crankshaft and in fluid communication with a lubricant oil sump and with parts of the unit requiring lubrication; and a hermetic shell enclosing the compressor unit, the electric motor, the oil pump and the lubricant oil sump, said oil pump comprising a cylindrical and eccentric portion (23) of the crankshaft (7) which is disposed in such a way as to slip within a cylindrical housing (26), said housing (26) being concentric to the geometric axis of the crankshaft (7); at least a curved and lengthened blade element (25) with a width corresponding to an axial length of the cylindrical housing (26), said blade element (25) having at least one edge attached at an attachment location (31) in an interior surface of the housing (26) and being inserted at an area of contact (28) between the cylindrical housing (26) and the eccentric portion (23) so as to define an admission chamber (29) and a pressure chamber (30) in each space of the cylindrical housing (26) defined between the attachment location (31) of the blade element (25) and the area of contact (28), the admission chamber (29) and the pressure chamber (30) being in fluid communication respectively with the lubricant oil collected in the oil sump and with the part of the crankshaft (7) and bearings (5 and 6) requiring lubrication.

2. Horizontal Crankshaft Hermetic Compressor according to claim 1, wherein said blade element (25) consists of a plastic material film that is thermally resistant and compatible with the chemical conditions of the medium.

3. Horizontal Crankshaft Hermetic Compressor according to claim 1, wherein said blade element (25) is a metal with properties of flexibility, wear and fatigue resistance.

4. Horizontal Crankshaft hermetic Compressor according to claim 1, wherein the admission chamber (29) of the oil pump is connected to the oil sump (34) in the bottom of the shell (3) by means of a suction hole (33*a*) made through the main (5) or sub bearing (6).

5. Horizontal Crankshaft Hermetic Compressor according to claim 1, wherein the admission chamber (29) of the oil pump is connected to the oil sump (34) in the bottom of the shell (3) by means of a suction pipe (33*b*).

6. Horizontal Crankshaft Hermetic Compressor according to claim 1, wherein the pressure chamber (30) is connected to a central oil feed hole (39) by means of an oil discharge hole (38) radially disposed through the eccentric portion (23), this central oil feed hole (39) being in fluid communication with the parts of the surface of the crankshaft (7) requiring lubrication by means of radial openings (38*a*) which are made on the crankshaft (7).

7. Horizontal Crankshaft Hermetic Compressor according to claim 1, wherein the pressure chamber (30) is connected to the sub bearing (6) and main bearing (5) by means of lubrication grooves.

8. Horizontal Crankshaft Hermetic Compressor according to claim 7, wherein the lubrication grooves are made in the surface of the crankshaft (7) in shape of helical grooves (35).

9. Horizontal Crankshaft Hermetic Compressor according to claim 7, wherein the lubrication grooves (40) are in a cylindrical internal surface of a front cover (37) of the sub bearing (6) and in the surface of the sub bearing (6) and main bearing (5).

10. Horizontal Crankshaft Hermetic Compressor according to claim 8, wherein the peripheral end of the oil discharge hole (38) is set in a slightly advanced angular position respective to the point of contact (28) between the eccentric portion (23) and the internal surface of the housing (26).

11. Horizontal Crankshaft Hermetic Compressor according to claim 1, wherein one of the lateral walls of the cylindrical housing (26) is defined by part of the lateral surfaces (24*a*) of the piston (8).

12. Horizontal Crankshaft Hermetic Compressor according to claim 1, wherein said oil pump has features of positive displacement.

13. Horizontal crankshaft Hermetic Compressor according to claim 1 wherein one of the lateral walls of the cylindrical housing is defined by part of the eccentric portion of the crankshaft.

14. Horizontal crankshaft Hermetic Compressor according to claim 11, wherein the one of the lateral walls of the cylindrical housing is also defined by the eccentric portion of the crankshaft.

15. Horizontal Crankshaft Hermetic Compressor according to claim 1, wherein said housing is in one of the bearings.

16. Horizontal Crankshaft Hermetic Compressor according to claim 1, wherein said housing is in front cover of the sub bearing.

17. A horizontal crankshaft hermetic compressor according to claim 1, further comprising:

means for rotatably driving said crankshaft.

18. An oil pump for a horizontal crankshaft compressor, comprising:

a housing with an inner surface;

an eccentric portion of a driveable crankshaft having a central axis offset from the central axis of said driveable crankshaft, said eccentric portion sweeping said inner surface; and a blade element extending an axial length of said housing, said blade element having at least one edge attached to said inner surface of said housing at an attachment location and being inserted at an area of contact between said housing and said eccentric portion so as to define an admission chamber and a pressure chamber in said housing, said chambers on opposite sides of said blade element thereby being separated by said blade element between said attachment location and said area of contact.

19. An oil pump according to claim 18, further comprising:

a lubricant oil sump for collecting lubricant oil, said admission chamber and said pressure chamber respectively being in fluid communication with said oil sump.

20. An oil pump according to claim 18, wherein said blade element has another edge attached to said inner surface of said housing.

* * * * *

UNITED STATES PATENT AND TRADEMARK OFFICE

CERTIFICATE OF CORRECTION

PATENT NO. : 4,902,205

DATED : February 20, 1990

INVENTOR(S) : Caio M.F.N. DaCosta, et al

It is certified that error appears in the above-indentified patent and that said Letters Patent is hereby corrected as shown below:

In the cover page of the patent, item (73), please delete "Empresa Brasileira De Compressores S. A." and substitute therefor --Empresa Brasileira de Compressores S.A. - EMBRACO--.

Signed and Sealed this

Eighth Day of November, 1994

*Attest:*

*Attesting Officer*

BRUCE LEHMAN

*Commissioner of Patents and Trademarks*